United States Patent [19]

Koester et al.

[11] Patent Number: 4,826,066

[45] Date of Patent: May 2, 1989

[54] STAPLE INSERTION APPARATUS

[76] Inventors: William L. Koester, R.R. #1, Box 232; Daniel L. Koester, R.R. #1, Box 232A, both of Poseyville, Ind. 47633

[21] Appl. No.: 48,739

[22] Filed: May 11, 1987

[51] Int. Cl.[4] ..... B25C 1/02

[52] U.S. Cl. ..... 227/120; 227/129; 227/134; 227/147

[58] Field of Search ..... 47/9; 111/1, 4; 405/19; 227/120, 129, 156, 147, 134

[56] References Cited

U.S. PATENT DOCUMENTS

| | | | |
|---|---|---|---|
| 1,441,474 | 1/1923 | Anderson | 227/129 X |
| 1,919,944 | 7/1933 | Hicks | 227/129 X |
| 3,035,269 | 5/1962 | Latsch et al. | 227/134 X |
| 4,139,136 | 2/1979 | Catalano | 227/147 X |
| 4,377,919 | 3/1983 | Cams | 47/9 X |
| 4,627,563 | 12/1986 | Meyer | 227/120 X |
| 4,706,864 | 11/1987 | Jacobsen et al. | 227/125 |

FOREIGN PATENT DOCUMENTS

| | | | |
|---|---|---|---|
| 1146476 | 4/1963 | Fed. Rep. of Germany | 227/124 |

*Primary Examiner*—Paul A. Bell
*Attorney, Agent, or Firm*—Rodger H. Flagg

[57] ABSTRACT

A staple insertion apparatus is disclosed for sequentially inserting a plurality of staples through a selected material, into the ground. A housing having a top, bottom, and sides, with first and second open ends, forms a chamber therebetween. The chamber is sized to receive a plurality of staples selected from four to 12 inches in length. The staples are inserted into the chamber from the second open end. A staple advancing member biases the staples towards the first open end. A vertically disposed tubular member is secured to the housing above the first open end of the chamber. An elongated drive member is slidably disposed at least partially within the tubular member. A staple retaining member positions the forewardmost staple beneath the elongated drive member. A foot actuation member is secured to the drive member. The drive member forcibly biases the forwardmost staple through the selected material, into the ground, when the operator exerts a downward force from a standing position upon the foot actuation member. As the operator's foot is raised, a biasing member disposed within the tubular member, raises the drive member. The staple advancing member positions the next staple beneath the drive member for subsequent insertion of the next staple through the material, into the ground.

17 Claims, 3 Drawing Sheets

STAPLE INSERTION APPARATUS

FIELD OF THE INVENTION

This invention relates to staple insertion apparatus, and more particularly to an apparatus for sequentially inserting large, generally U-shaped staples through agricultural mats, erosion control mats, or other sheet like material, into the ground.

BACKGROUND OF THE INVENTION

There are many known applications where it is desirable to stake or staple large mat or sheet materials to the ground, in order to improve growing conditions, or to control soil erosion, or the like. Some mat materials may incorporate seeds, fertilizers, or various forms of weed control to improve growing conditions. Mat or sheet material may be employed to control soil erosion. The mat or sheet material may be tailored to follow the uneven contour of the ground.

The insertion of stakes or staples through the mat or sheet material into the ground at suitably spaced intervals, serves to retain the material in place against the effects of wind, water and other elements. Manual insertion of stakes or staples is typically achieved with a hammer or driving tool. This requires the operator to stoop, kneel or crawl along the mat in order to position and drive each stake into the ground. This is tedious and time consuming, due to the expansive nature of the material to be secured, and the number of stakes or staples required to effectively secure the material to the ground.

The stakes or staples must penetrate the ground to a sufficient depth to ensure retention in a variety of soil conditions and against the forces of nature. This requires stakes or staples to be much longer in size, then staples typically employed to secure roofing material, or the like. Preferably, staples used to secure material to the ground are from four to 12 inches long. A much greater driving force is required to drive these staples through the material into the ground than is employed to drive conventional staples to secure roofing material, or the like.

Thus conventional staple apparatus, which employs the force generated by an operator's grip, hand or arm motion is insufficient to drive staples four to 12 inches long into the ground in a variety of soil conditions typically found where erosion control mats, or the like, are needed.

Accordingly, the present invention employs a force generated by the operator's foot, assisted by the operator's body weight, to drive the staples through the material and into the ground.

RELEVANT PRIOR ART

U.S. Pat. No. 4,377,919 discloses a hold down system for horticultural plastic sheet, which employs "T", "L" or inverted "w" shaped fasteners, which are each manually positioned and inserted into the ground with a driving tool utilizing a combination of hand and foot power.

U.S. Pat. No. 3,890,910 discloses a wicket-shaped hold down apparatus for plastic sheets, utilizing an air gun for insertion of each hold down apparatus.

U.S. Pat. No. 360,225 discloses a three pronged staple for securing a wire to the ground to retain flexible material beneath the wire for erosion control.

U.S. Pat. No. 2,409,049 discloses a hand actuated staple driving apparatus for inserting tilt-top staples into a roof. This apparatus utilizes a magazine for holding several rows of tilt-top staples for sequential stapling of small staples.

U.S. Pat. No. 3,042,925 discloses a nail driving apparatus for sequential insertion of a nail when a plunger is struck by a hammer or mallet.

U.S. Pat. No. 407,444 discloses a tack driving apparatus utilizing a spring loaded hammer actuated by manually squeezing a lever.

U.S. Pat. No. 1,441,474 discloses a staple apparatus to start staples, wherein the apparatus is removed and the staple is then struck with a hammer to drive the staple home. This apparatus is magazine fed for sequential actuation.

SUMMARY OF THE INVENTION

The staple insertion apparatus disclosed herein utilizes the force of the operator's foot, assisted by the operator's body weight, to drive a large staple through mat or sheet material into the ground to secure and retain the material against the ground.

The staples are preferably secured together in an aligned juxtaposed relation for ease of handling and insertion of a plurality of staples into the staple insertion apparatus. The operator positions the staple insertion apparatus upon the mat or sheet material to be secured to the ground from a standing position, and inserts a staple into the ground by stepping upon a foot actuation member, which biases a drive member downwardly against a staple. Upon complete insertion, the operator raises his foot, allowing a biasing means to raise the drive member to an upper operating position in preparation for insertion of the next staple.

The staple insertion apparatus herein disclosed, is durable, easily actuated from a standing position, and provides a means for rapid insertion of staples over a large area to secure the mat or sheet material, hereafter referred to as "selected material," to the ground. No external power source or motor driven apparatus is required to drive the staples into the ground.

Therefore, one object of the present invention is to provide an improved staple insertion apparatus for driving staples through a selected material, into the ground.

Another object of the present invention is to provide an improved staple insertion apparatus operable from a standing position and utilizing the force provided by the operator's foot, for driving a staple into the ground.

Yet another object of this invention is to provide an improved staple insertion apparatus adapted to receive a plurality of staples in aligned, juxtaposed relation, for sequential insertion by the downward actuation of the operator's foot.

Yet another object of this invention is to provide a staple insertion apparatus capable of inserting staples of various lengths into the ground, wherein staple length is selected for suitability to the soil conditions of the ground, where the selected material is to be secured.

Still another object is to provide an improved staple insertion apparatus embodying any combination of the objects previously disclosed.

The above mentioned and other features and objects of this invention and the manner of attaining them will be best understood by reference to the following description of an embodiment of the invention, when considered in conjunction with the accompanying drawings.

BEST MODE FOR CARRYING OUT THE INVENTION

Figure 1:
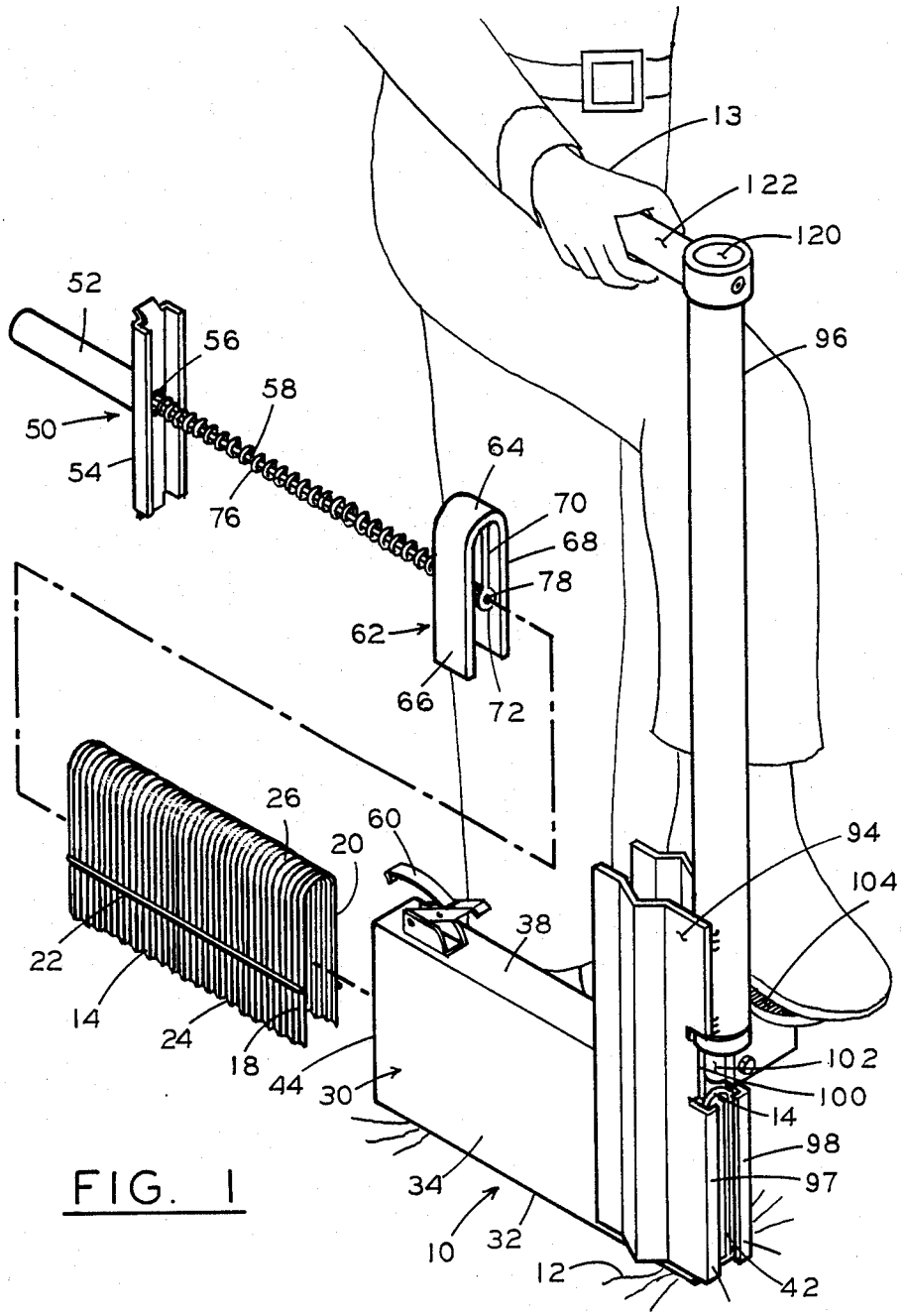
FIG. 1 shows a perspective view of the staple insertion apparatus with the staple advancing means and a plurality of staples shown in exploded view. An operator is partially shown in position to begin insertion of a staple through the selected material.

The subject matter which I regard as my invention is particularly pointed out and distinctly claimed in the claims. The structure and operation of my invention, together with further objects and advantages, may be better understood from the following description given in connection with the accompanying drawings, in which:

FIG. 1 shows the staple insertion apparatus 10, positioned upon a large portion of selected material 12 and supported by an operator 13 in preparation for insertion of a staple 14 through selected material 12, into the ground (not shown). A plurality of staples 14 are shown in exploded view, in aligned, juxtaposed relation. For ease of handling and insertion, staples 14 are preferably secured together by one or more transverse strips 22 secured to each staple 14. The ends 24 of each staple are preferably inclined to aid insertion of staple 14 into the ground 16. Each staple 14 may be formed from wire, strip, or sheet material into a generally U-shaped configuration having a top portion 26 and depending side portions 18, 20. The adjoining top 26 and side portions 18, 20 of each staple 14 are preferably radiused to avoid stress concentration. In order to satisfactorily retain the selected material 12 against the ground 16, and oppose the forces of nature acting to displace the selected material 12, the length of each staple 14 is preferably selected from four to 12 inches in length.

Staple width is preferably selected from one-half of an inch to two inches in width. The thickness of the staple material is selected to avoid buckling during insertion of staple 14 into ground 16. Thus, staple thickness may vary depending on the type of staple material selected. A steel staple formed of one-eight inch diameter wire with a one quarter inch radius between top 26 and sides 18, 20, having a length of approximately six inches and a width of approximately one and one quarter inches has been found to produce satisfactory results in most soil conditions. Heavy clay or rocky soil may require a staple only 4 inches long, whereas sandy soil may require a longer staple on the order of 12 inches long.

The staple insertion apparatus 10 of FIGS. 1 through 4 comprises an elongated, horizontally disposed housing 30 having a bottom portion 32, opposing side portions 34, 36 adjacent to the bottom portion 32, and a top portion 38 adjacent to the side portions 34, 36, forming a chamber 40 therebetween. Chamber 40 is sized to slidably receive staples 14 therein. Where more than one staple length is desired, due to differing soil conditions, chamber 40 is preferably sized to receive the longest staple 14 required. Alternately, a staple insertion apparatus 10 may be sized to fit a narrow range of staple lengths, with different staple insertion apparatus adapted to accept different staple lengths.

The opposing ends of chamber 40 form a first open end portion 42, and a second open end portion 44. A plurality of staples 14 are inserted through second open end portion 44, and are linerally biased by a staple advancing means 50 towards the first open end portion 42.

Figures 2, 3:
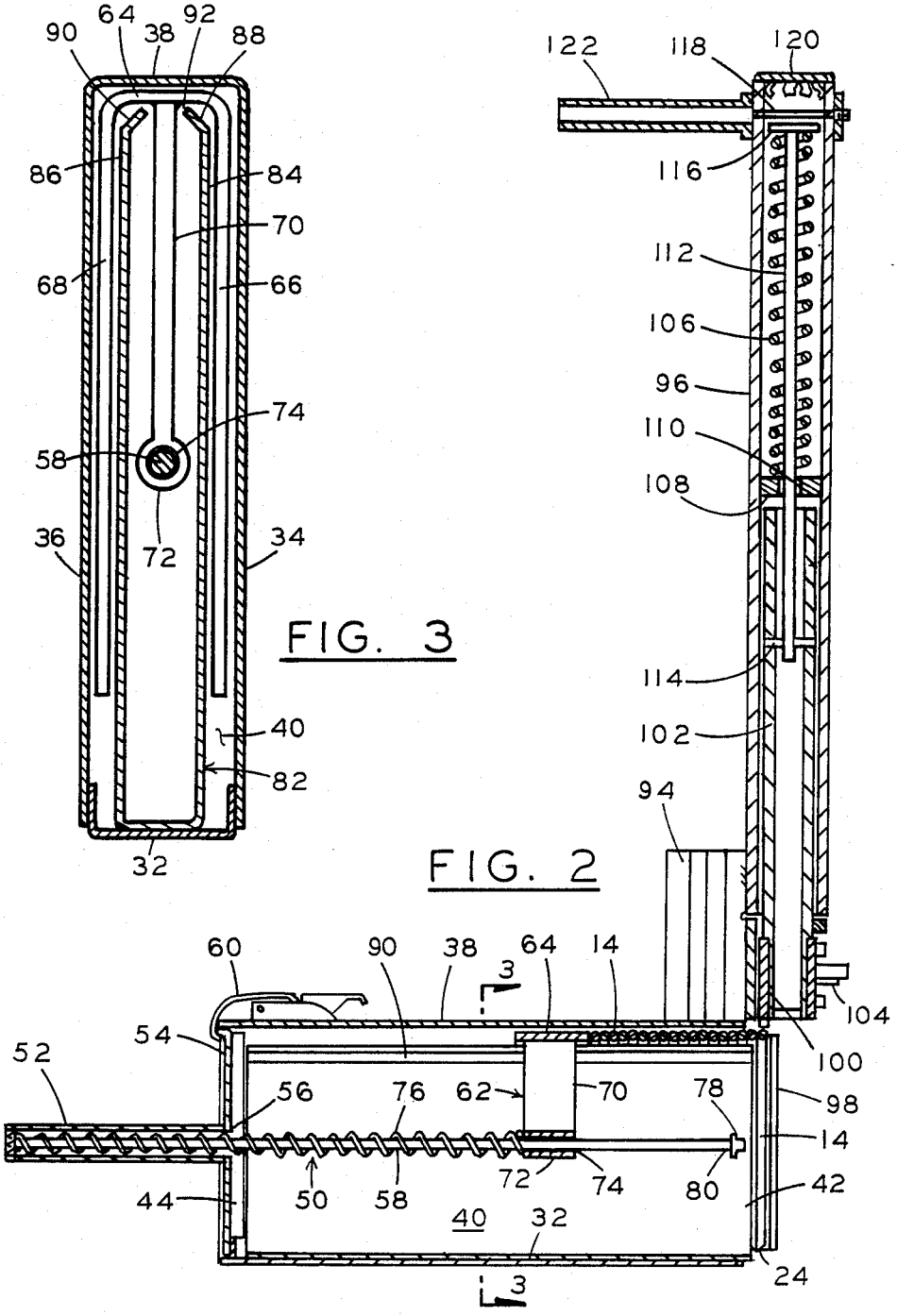
FIG. 2 is a cross sectional view of the staple insertion apparatus with the staple advancing apparatus releasably secured within the housing.
FIG. 3 is a cross sectional view of the housing, taken along lines 3—3 in FIG. 2.
Figure 4:
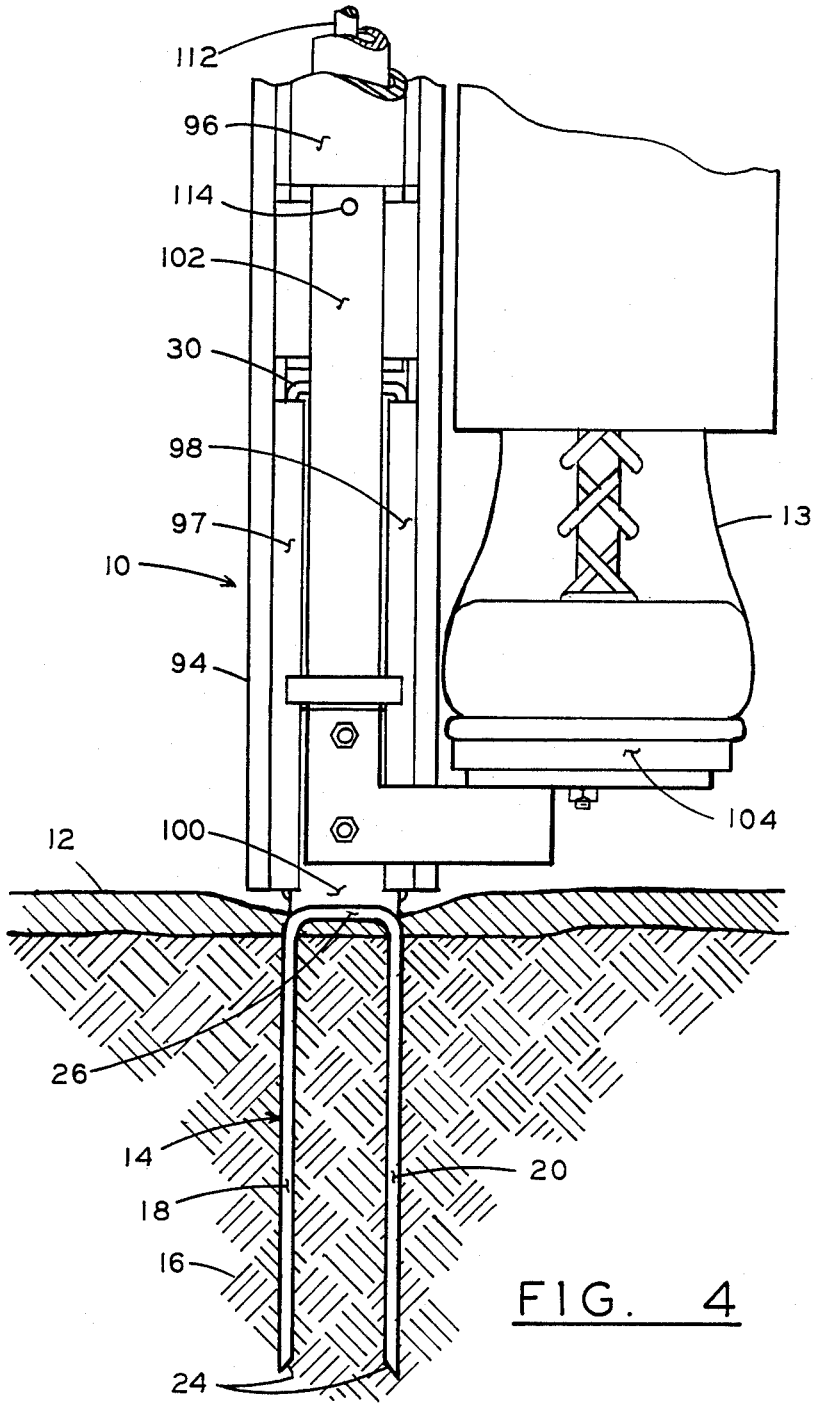
FIG. 4 is an end view of the staple insertion apparatus, with the elongated drive member positioned in the lower operating position.

As best shown in FIG. 1 and FIG. 3, the staple advancing means 50 preferably comprises a tubular handle portion 52 extending externally from an end closure member 54 having an aperture 56 therethrough. An elongated rod 58 is secured at one end in spaced relation within tubular handle portion 52, and extends in spaced relation through aperture 56 in closure member 54. When the staple advancing means 50 is secured in proximity to the second open end portion 44 of chamber 40 by retaining means 60, elongated rod 58 is sized to extend substantially the length of chamber 40, as shown in FIG. 3.

A staple guide means 62 is sized to be slidably received within chamber 40, and to abut the staple 14 closest to the second open end portion 44. As best shown in FIG. 3, staple guide means 62 preferably comprises a top portion 64, and adjoining side portions 66, 68. A central extension 70 depends from top portion 64 in spaced relation between side portions 66, 68 to support a boss 72 having an aperture 74 therethrough.

Rod 58 is slidably disposed through aperture 74 in staple guide means 62, and a biasing means 76, such as a compression spring, preferably extends about rod 58 between staple guide means 62 and tubular handle 52. Tubular handle 52 is sized to substantially receive biasing means 76 therein when chamber 40 is fully loaded with a plurality of staples 14. Biasing means 76 is sized to linerally bias staple guide means 62 substantially towards the first open end portion 42 of chamber 40 in a manner to sequentially align each of the plurality of staples 14 disposed within chamber 40 in proximity to first open end portion 42. A retaining means 78 is preferably secured at end 80 of rod 58 to retain staple guide means on rod 58 when the staple advancing means 50 is removed from chamber 40 as shown in FIG. 1.

As shown in FIG. 3, staple support member 82 is secured to the bottom 32 of housing 30 within chamber 40 in spaced relation from top 38 and sides 34, 36. Preferably, staple support member 82 extends substantially the length of chamber 40 to support staples 14 as they are biased by the staple advancing means 50 towards the first open end 42. Staple support member 82 is preferably formed with sides 84, 86 extending in spaced relation from sides 34, 36 of housing 30, with upper ends 88, 90 inclined towards each other in spaced relation in a manner to support the top portion 26 of staples 14. This allows staples of various lengths to be utilized without adversely affecting actuation of the staple insertion apparatus 10. The space 92 between upper ends 88, 90 allow central extension 70 of staple guide means 62 to be slidably received therebetween. Staple guide means 62 is supported upon ends 88, 90, of staple support member 82 which serves to align staple guide means 62 in relation to the plurality of staples 14, regardless of staple length.

A housing support member 94 is secured to housing 30 in proximity to the first open end portion 42. Housing support member 94 may be fabricated of one or more pieces, and extends above housing 30 to secure a vertically disposed tubular member 96 in spaced relation above the first open end portion 42 of chamber 40.

A staple retaining means 97,98 serves to limit the travel of staples 14 in a manner to align the staple 14 closest to the first open end portion 42 beneath the staple drive member 100. Staple drive member 100 is sized to be slidably received between staple retaining means 97, 98 and the first open end 42 of chamber 40. Preferably, the bottom portion of drive member 100 is contoured to the general configuration of the top portion 26 of each staple 14. Staple retaining means 97, 98 may be secured to housing 30 or to housing support member 94 in accordance with manufacturing preference. Preferably, housing support member 94 is formed to become the staple retaining means 97, 98.

Staple drive member 100 is secured to an elongated drive member 102. The elongated drive member 102 is at least partially slidably received within tubular member 96. A foot actuation member 104 is also secured to elongated drive member 102 and is preferably releasably secured to elongated drive member 102 to allow positioning the foot actuation member 104 for use from the operator 13's left or right side, according to the operator's preference.

Referring now to FIG. 2, a biasing means is disposed within tubular member 96 in a manner to raise the elongated drive member 104 into the upper operating position shown in FIG. 1 and FIG. 3. In the preferred embodiment, an internal boss 108 is secured within tubular member 96. Internal boss 108 has an aperture 110 which is sized to slidably receive rod 112 therethrough. The lower end of rod 112 is preferably secured to elongated drive member 102, by pin 114. Preferably, pin 114 is positioned in drive member 102 to extend beneath tubular member 96 when drive member 102 is positioned in the lower operating position, for ease of assembly and repair. The upper end of rod 112 is secured to a retaining cap 116. Biasing means 106 acts to extend retaining cap 116 away from boss 108 which acts through rod 112 and pin 114 to raise elongated drive member 102 into the upper operating position.

As the operator's foot exerts a downward force against foot actuation member 104, the elongated drive member 102 is linerally biased towards the ground. This forces the staple drive member 100 to be driven against the staple 14 aligned beneath the staple drive member 100, forcibly separating staple 14 from the plurality of staples 14 disposed upon staple support member 82, and to forcibly drive the separated staple 14 into the ground.

The staple insertion apparatus 10 is designed for use from a standing position. Thus, as the operator 13 applies a downward force against foot actuation member 104, a substantial portion of the operator's weight may be shifted downwardly against foot actuation member 104, to drive staple 14 through the selected material, into the ground.

Upon complete insertion of staple 14 into the ground, the operator's foot is raised, allowing biasing means 106 to raise elongated drive member 102 from the lower operating position to the upper operating position, in preparation for insertion of the next staple 14. As staple drive member 100 is raised above the plurality of staples 14, the staple advancing means 50 urges the plurality of staples 14 towards the first open end 42 of chamber 40, forcing the forward most staple 14 against staple retaining means 97, 98. This serves to align the forwardmost staple 14 beneath staple drive member 100, in preparation for insertion of the next staple 14. Staple drive member 100 is slidably received between housing end 42 and staple retaining means 97, 98. This prevents rotational movement of drive member 102 in tubular member 96, as the operator linearly biases foot actuation member 104 between upper and lower operating positions.

For safety, a pin 118 may be secured in tubular member 96 above retaining cap 116 to inhibit the sudden extension of rod 112 above tubular member 96 in the event rod 112 becomes unsecured from elongated drive member 102.

A cap 120 may be releasably secured to the upper end of tubular member 96 in order to minimize the amount foreign material entering into tubular member 96. Likewise, the bottom portion of elongated drive member 102 may be plugged, or otherwise closed off to minimize the amount of foreign material entering into elongated drive member 102.

Staple support member 82 may also be closed off in proximity to end 42 of chamber 40, to minimize the amount of foreign material entering chamber 40. However, the space between sides 84, 86 of staple support member 82 and sides 34, 36 of chamber 40 must remain sufficiently open to allow passage of staples from chamber 40 to abut staple retaining means 97, 98 in order to properly position staple 14 beneath staple drive member 100, when the elongated drive member 102 is raised into the upper operating position shown in FIGS. 1 and 2.

In the preferred embodiment, a handle 122 is adjustably positioned and releasably secured to the upper portion of tubular member 96, for ease of positioning the staple insertion apparatus 10 by operator 13 during use. By grasping handle 122, the operator 13 may easily move and position the staple insertion apparatus 10 in preparation for insertion of staple 14. The operator 13 may then insert staple 14 through the selected material, into the ground, by stepping upon the foot actuation member 104. The operator may then quickly move one or more steps, and without substantially breaking stride, step down upon foot actuation member 104, driving another staple through the selected material 12, into the ground. The operator 13 may thus sequentially insert each of the plurality of staples 14 disposed within chamber 40 over a great expanse of selected material 12, in a very short time.

When all the staples 14 in chamber 40 have been inserted, the operator 13 may quickly reload the next plurality of staples 14 within chamber 40 by releasing retaining means 60 and removing staple advancing means 50 from chamber 40. The operator 13 may then load the next plurality of staples 14 within chamber 40 and then insert the staple advancing means 50 into chamber 40 and secure the staple advancing means 50 to housing 30 with retaining means 60.

Thus, while the novel staple insertion apparatus has been fully described and disclosed, numerous modifications will become readily apparent to one of ordinary skill in this art, and such adaptations and modifications are intended to be included within the scope of the following claims.

What is claimed is:

1. A staple insertion apparatus for sequentially inserting a plurality of staples through a selected material into the ground, when actuated by an operator from a standing position, which comprises:

(a) an elongated housing having a bottom portion, opposing side portions adjacent to the bottom portion in spaced relation from each other, and a top portion adjacent to the side portions, forming a chamber therebetween with opposing first and second open end portions; the chamber sized to receive the plurality of staples therein;

(b) at least one housing support member secured to the housing in proximity to the first open end portion;

(c) a vertically disposed tubular member secured to the housing support member above the first open end portion of the chamber, the tubular member extending upwardly for support of the apparatus by the operator from a standing position;

(d) an elongated drive means slidably disposed at least partially within the tubular member above the first open end portion when the drive means is in an upper operating position, and extending substantially across the first open end portion when the drive means is disposed in a lower operating position;

(e) a foot actuation member releasably secured to the drive member, and selectively positioned to extend to either side of the housing in accordance with the operator's preference;

(f) a first biasing means disposed within the tubular member to bias the drive means into the upper operating position;

(g) a staple advancing means, releasably secured to the housing in proximity to the second open end portion for urging the plurality of staples within the chamber towards the first open end portion of the housing; and (h) a staple retaining means disposed in spaced relation from the first open end portion of the housing and disposed to position one of the plurality of staples in position for insertion beneath the drive means;

wherein, the operator positions the staple insertion apparatus upon the selected material, and exerts a substantial downward force from a standing position upon the foot actuation member to bias the drive means from the upper operating position to the lower operating position to drive the staple ends through the selected material into the ground, whereupon the operator's foot is raised, allowing the first biasing means to raise the drive means to the upper operating position, as the staple advancing means biases the plurality of staples within the chamber to align the next staple beneath the drive means in preparation for insertion of the next staple through the selected material, and into the ground.

2. The apparatus of claim 1 wherein the housing is sized to receive a plurality of staples therein, each staple having a top and depending sides forming a generally inverted U-shaped configuration whose preferred size is selected from a range of from four to 12 inches in length, from one-half inch to two inches in width, and of a thickness sufficient to avoid substantial backing during insertion of the staple into the ground.

3. The apparatus of claim 1, wherein each staple has tapered insertion ends to aid in penetration of the staple into the ground.

4. The apparatus of claim 1, wherein a handle is adjustably positioned and releasably secured to the upper portion of the tubular member for ease of positioning the apparatus by the operator from a standing position during use.

5. The apparatus of claim 1, wherein a staple support member is secured to the bottom portion of the housing, with sides extending in spaced relation to the housing sides and top, the sides of the staple support member extending substantially the length of the housing, and positioned to support the plurality of staples thereon.

6. The apparatus of claim 1, wherein the housing support member is configured to form the staple retaining means, to extend beyond the first open end portion of the housing to confront the staples biased by the staple advancing means to position one of the plurality of staples beneath the drive means, in preparation for insertion of the staples through the selected material, into the ground.

7. The apparatus of claim 1, wherein a staple drive member is secured to the elongated drive means, with the staple drive member slidably disposed between the first open end portion of the housing and the staple retaining means, and the staple confronting portion of the staple drive member is configured to conform to the general external profile of the top portion of one of the staples.

8. The apparatus of claim 1, wherein the staple advancing means comprises:

(a) an end closure member sized to substantially enclose the second open end portion of the housing, a tubular handle portion externally secured to the end closure member in alignment with an aperture disposed through the end closure member;

(b) an elongated rod secured to the external end of the tubular handle, and extending in spaced relation through the tubular handle and the aperture, the elongated rod extending substantially the length of the housing chamber when the staple advancing means is releasably secured to the housing;

(c) a staple guide means configured with a top portion and adjoining side portions depending from the top portion, with a central extension depending from the top portion in spaced relation between the side portions, with an aperture disposed through the central extension and slidably disposed upon the elongated rod; and (d) a second biasing means disposed upon the elongated rod between the end closure member and the staple guide means;

wherein, the second biasing means is configured to extend the staple guide means substantially the length of the chamber when the staple advancing means is releasably secured to the housing, and the second biasing means is substantially compressed within the tubular handle when the chamber is fully loaded with a plurality of staples.

9. The apparatus of claim 1, wherein the first biasing means comprises: an internal boss with an aperture therethrough, secured within the tubular member; an elongated rod slidably disposed through the aperture in the boss, with a retaining cap disposed upon the upper end of the elongated rod, with the lower end of the elongated rod secured to the drive member; and a biasing member disposed between the retaining cap of the elongated rod and the internal boss within the tubular member in a manner to bias the drive means secured to the elongated rod into the upper operating position.

10. A staple insertion apparatus, which comprises:

(a) an internal chamber formed of a bottom, opposing sides and a top portion, the chamber having first and second open end portions sized to receive a plurality of staples therein, each staple having a top portion selected from one half to two inches in width; and depending side portions selected from four to twelve inches in length; and of a thickness sufficient to avoid substantial buckling during insertion of the staple into the ground;

(b) a staple advancing means releasably secured in proximity to the second open end portion of the chamber, the staple advancing means for urging the plurality of staples towards the first open end portion of the chamber;

(c) a vertically disposed tubular member secured to the chamber above the first open end portion;

(d) an elongated drive means at least partially disposed within the tubular member;

(e) a staple retaining means disposed in spaced relation beyond the first open end portion of the housing for positioning the forward most staple beneath the elongated drive means;

(f) a biasing means disposed within the tubular member, to raise the elongated drive means into an upper operating position; and (g) a foot actuation means releasably secured to the elongated drive means, and selectively positioned to extend to either side of the housing in accordance with the operator's preference, the foot actuation means for biasing the drive means from the upper operating position to a lower operating position, wherein, the staple ends disposed beneath the drive means are forcibly driven through the selected material into the ground as the operator exerts a downward force upon the foot actuation means, and when the operator's foot is raised, the biasing means raises the drive means from the lower operating position to the upper operating position as the staple advancing means positions the next adjacent staple beneath the elongated drive means in preparation for subsequent staple insertion.

11. The apparatus of claim 10, wherein each staple has tapered insertion ends to aid in penetration of the staple into the ground.

12. The apparatus of claim 10, wherein a handle is adjustably positioned and releasably secured to the upper portion of the tubular member for ease of positioning the apparatus by the operator from a standing position during use.

13. The apparatus of claim 10, wherein a staple support member is secured to the bottom portion of the housing, with sides extending in spaced relation to the housing sides and top, the sides of the staple support member extending substantially the length of the housing, and positioned to support the plurality of staples thereon.

14. The apparatus of claim 10, wherein a staple drive member is secured to the elongated drive means, with the staple drive member slidably disposed between the first open end portion of the housing and the staple retaining means, and the staple confronting portion of the staple drive member is configured to conform to the general external profile of the top portion of one of the staples.

15. The apparatus of claim 10, wherein the staple advancing means comprises:

(a) an end closure member sized to substantially enclose the second open end portion of the housing, a tubular handle portion externally secured to the end closure member in alignment with an aperture disposed through the end closure member;

(b) an elongated rod secured to the external end of the tubular handle, and extending in spaced relation through the tubular handle and the aperture, the elongated rod extending substantially the length of the housing chamber when the staple advancing means is releasably secured to the housing;

(c) a staple guide means configured with a top portion and adjoining side portions depending from the top portion, with a central extension depending from the top portion in spaced relation between the side portions, with an aperture disposed through the central extension and slidably disposed upon the elongated rod; and (d) a second biasing means disposed upon the elongated rod between the end closure member and the staple guide means;

wherein, the second biasing means is configured to extend the staple guide means substantially the length of the chamber when the staple advancing means is releasably secured to the housing, and the second biasing means is substantially compressed within the tubular handle when the chamber is fully loaded with a plurality of staples.

16. A staple insertion apparatus for sequentially inserting a plurality of staples through a selected material into the ground, when actuated by an operator from a standing position, which comprises:

(a) an elongated housing having a bottom portion, opposing side portions adjacent to the bottom portion in spaced relation from each other, and a top portion adjacent to the side portions, forming a chamber therebetween with opposing first and second open end portions; the chamber sized to receive the plurality of staples therein;

(b) at least one housing support member secured to the housing in proximity to the first open end portion;

(c) a vertically disposed tubular member secured to the housing support member above the first open end portion of the chamber, the tubular member extending upwardly for support of the apparatus by the operator from a standing position;

(d) an elongated drive means slidably disposed at least partially within the tubular member above the first open end portion when the drive means is in an upper operating position, and extending substantially across the first open end portion when the drive means is disposed in a lower operating position;

(e) a foot actuation member secured to the drive means and extending therefrom;

(f) a first biasing means having an internal boss with an aperture therethrough, secured within the tubular member; an elongated rod slidably disposed through the aperture in the boss, with a retaining cap disposed upon the upper end of the elongated rod, with the lower end of the elongated rod secured to the drive member; and a biasing member disposed between the retaining cap of the elongated rod and the internal boss within the tubular member in a manner to bias the drive means secured to the elongated rod into the upper operating position;

(g) an end closure member sized to substantially enclose the second open end portion of the housing, a tubular handle portion externally secured to the end closure member in alignment with an aperture disposed through the end closure member;

(h) an elongated rod secured to the external end of the tubular handle, and extending in spaced relation through the tubular handle and the aperture, the elongated rod extending substantially the length of the housing chamber when the staple advancing means is releasably secured to the housing;

(i) a staple guide means configured with a top portion and adjoining side portions depending from the top portion, with a central extension depending from the top portion in spaced relation between the side portions, with an aperture disposed through the central extension and slidably disposed upon the elongated rod;

(j) a second biasing means disposed upon the elongated rod between the end closure member and the staple guide means to bias the staple guide means towards the first open end portion of the chamber;

(k) a staple retaining means disposed in spaced relation from the first open end portion of the housing and disposed to position one of the plurality of staples in position for insertion beneath the drive member;

(l) a staple support member secured to the bottom portion of the housing, with sides extending in spaced relation to the housing sides and top, the sides of the staple support member extending substantially the length of the housing, and positioned to support the plurality of staples thereon;

wherein, the operator positions the staple insertion apparatus upon the selected material, and exerts a substantial downward force from a standing position upon the foot actuation member to bias the drive means from the upper operating position to the lower operating position to drive the staple ends through the selected material, into the ground, whereupon the operator's foot is raised, allowing the first biasing means to raise the drive means to the upper operating position, as the staple guide means biases the plurality of staples within the chamber to align the next staple beneath the drive means in preparation for insertion of the next staple through the selected material, and into the ground.

17. The apparatus of claim 16, wherein a staple drive member is secured to the elongated drive means, with the staple drive member slidably disposed between the first open end portion of the housing and the staple retaining means, and the staple confronting portion of the staple drive member is configured to conform to the general external profile of the top portion of one of the staples.

* * * * *